United States Patent [19]

Fitzgerald et al.

[11] Patent Number: 5,057,121

[45] **Date of Patent: * Oct. 15, 1991**

[54] PROCESS FOR IMPARTING STAIN-RESIST AGENT

[75] Inventors: Patrick H. Fitzgerald, Pitman, N.J.; Joyce M. Materniak, Hockessin, Del.; Mead S. Moores, Wilmington, Del.; Ella D. Openstone, Wilmington, Del.; Ernest Rivet, Wilmington, Del.

[73] Assignee: E. I. Du Pont de Nemours and Company, Wilmington, Del.

[ * ] Notice: The portion of the term of this patent subsequent to Nov. 28, 2006 has been disclaimed.

[21] Appl. No.: 389,894

[22] Filed: Aug. 4, 1989

[51] Int. Cl.[5] ..... D06M 15/41; D06M 23/00; D06M 15/19

[52] U.S. Cl. ..... 8/133; 8/115.56; 252/8.6; 252/8.7

[58] Field of Search ..... 8/115.56, 115.61, 557, 8/DIG. 21, 560, 133; 252/87

[56] References Cited

U.S. PATENT DOCUMENTS

| | | | |
|---|---|---|---|
| 3,835,071 | 9/1974 | Allen et al. | 252/545 |
| 4,501,591 | 2/1985 | Ucci et al. | 8/560 |
| 4,822,373 | 4/1989 | Olson et al. | 8/115.6 |
| 4,865,885 | 9/1989 | Herlant et al. | 8/527 |
| 4,883,009 | 5/1989 | Marshall | 8/560 |
| 4,883,839 | 11/1989 | Fitzgerald et al. | 525/136 |
| 4,892,558 | 1/1990 | Blyth et al. | 8/560 |

*Primary Examiner*—Paul Lieberman

[57] ABSTRACT

A process for imparting stain resistance to polyamide substrates in continuous processes such as those using a Fluidyer® apparatus or a Flexnip® applicator and involving the application of a stain-resist composition containing a mixture of a hydrolyzed copolymer of maleic anhydride and one or more ethylenically unsaturated aromatic monomers with a sulfonated phenol-formaldehyde condensation product is disclosed wherein the stain-resist composition is applied at a pH between about 1.5 and about 3.0 in the prescence of an anionic surfactant in the form of an alkyl aryl sulfonic acid or an alkyl aryl sulfonate salt.

14 Claims, No Drawings

PROCESS FOR IMPARTING STAIN-RESIST AGENT

TECHNICAL FIELD

This invention relates to improved processes for imparting stain-resistant compositions comprising modified polymeric sulfonated phenol-formaldehyde condensation products and the hydrolyzed copolymers of maleic anhydride and ethylenically unsaturated aromatic monomers to polyamide textile substrates. The invention is particularly useful in treating polyamide carpeting in continuous processes such as those using a Fluidyer ® apparatus or a Flexnip ® applicator.

BACKGROUND OF THE INVENTION

The use of sulfonated naphthol- or sulfonated phenol-formaldehyde condensation products as acid-dye-resist, levelling, or wet-fastness agents for polyamide textile substrates is well known in the art. Because of their acid-dye-resist properties, these condensation products, when applied to polyamide textile substrates, act as stain-resist agents against subsequent staining by foodstuffs containing acid-dye colorants. (Materials and compositions which act to render such substrates resistant to acid dyes are referred to alternatively herein as stain-resist agents or stain-resist compositions.)

One particular class of stain-resist compositions which comprise mixtures of sulfonated phenol-formaldehyde condensation products with a hydrolyzed copolymer of maleic anhydride and one or more ethylenically unsaturated aromatic monomers is described by Fitzgerald, Rao, Vinod and Alender U.S. patent application, Ser. No. 07/280,406, now U.S. Pat. No. 4,883,889. The entire disclosure of this application, which is subject to an obligation of assignment to a common assignee, is hereby incorporated by reference herein.

Compositions containing stain-resist agents may be applied to polyamide substrates using a variety of methods, including application to filaments in a spin-finish during fiber manufacture, application to a yarn or a textile substrate such as tufted carpet in a dye bath as, for example, in a beck apparatus, or application following dyeing in a beck or continuous dyeing process. Processes for applying the stain-resist compositions described in the aforementioned U.S. patent application are taught by the same inventors in their divisional application, Ser. No. 07/280,404, now refiled as Ser. No. 07/465,40. Polyamide substrates made stain-resistant by such compositions are the subject of another divisional application, Serial No. 07/280,405, now refiled as Serial No. 07/426,933. The entire disclosure of each of these applications, which are also subject to an obligation of assignment to a common assignee, is hereby incorporated by reference herein as well.

When stain-resist compositions are applied in batch processes, such as in a beck, they may be used at relatively high dilution factors since the amount of time the substrate is immersed in the bath is typically on the order of thirty minutes to an hour which is sufficient to achieve good exhaust and good fixation of the stain-resist agent onto the substrate. Because of the high liquor to goods ratio in the bath, a wide range of pH values (typically 2–5) may be used to achieve acceptable stain-resistance in the finished product. However, the long residence times required to achieve adequate exhaust and fixation of the stain-resist agent onto the substrate limit the degree of productivity that can be achieved in a batch process This, combined with increased water consumption and effluent-treatment problems make it desirable to apply stain-resist agents in a continuous process.

Stain-resist compositions may be applied to polyamide (or polyamide-containing) textile substrates such as carpets in continuous processes using any of a number of widely-known apparatus designed for liquid application to a moving web via immersion, spraying, or other means. Examples of such equipment include a Kusters Fluidyer ®, such as the type described in U.S. Pat. No. 4,576,112, which uses a flexible air bladder to push the carpet against a fluid application slot to achieve uniform and deep penetration of the fluid into the pile fabric. Another increasingly-common type of continuous applicator is a Kusters Flexnip ® apparatus which is now widely accepted in the carpet industry as an effective means for application of stain-resist chemicals to dyed carpets. This class of applicator, which squeezes the carpet to apply the composition to the moving substrate, is described in the November 1987 issue of *Carpet & Rug Industry.*

To apply stain-resist agents in a continuous process, any apparatus or applicator may be used that provides adequate wet-out and uniform application of the fluid throughout the tufted carpet structure. The stain-resist solutions may be applied using such an apparatus in a second pass through the continuous dye line in which the stain-resist solution is substituted for the dye solution in the dye applicator, or in a single pass by including in the line a separate applicator for applying the stain-resist after dyeing. The stain-resist solution may also be added to the dye solution itself to effect the application in a single pass. Alternatively, stain-blocking agents also may be applied to beck-dyed carpets by installing an application apparatus, such as a Kusters Flexnip ® prior to the wet goods drier.

When applying stain-resist agents in continuous processes such as those described above or others known in the art, stain-resist solutions of higher concentration than those effective in batch processes are typically required to achieve acceptable stain resistance since such processes use lower temperatures, significantly shorter residence times, and lower liquor to goods ratios. When stain-resist solutions comprising mixtures of sulfonated phenol-formaldehyde condensation products and hydrolyzed copolymers of maleic anhydride and one or more ethylenically unsaturated aromatic monomers are applied to textile substrates in a continuous process, it is desirable that the pH of the stain-resist solution be less than about 3. If the pH is greater than about 3, insufficient exhaust and/or poor fixation of the stain-resist agents is obtained so that the finished substrate exhibits an unacceptably low degree of acid-stain resistance, either initially, after washing or both. However, when the pH of these stain-resist compositions is reduced to below about 3, the hydrolyzed maleic anhydride copolymers precipitate out of solution at the concentrations required to achieve acceptable stain resistance in continuous application processes. This significantly reduces the amount of active ingredient available to treat the carpet or substrate resulting in poor stain resistance in the finished substrate.

SUMMARY OF THE INVENTION

The present invention relates to a process for imparting stain resistance to polyamide substrates in continuous processes, such as those using a Fluidyer ® apparatus or a Flexnip ® applicator, which comprises applying to the substrates aqueous preparations of stain-resist compositions comprising between about 5 and 70 weight % of a sulfonated phenol-formaldehyde condensation product and between about 95 and 30 weight % of a hydrolyzed copolymer of maleic anhydride and one or more ethylenically unsaturated aromatic monomers, based on the total weight of stain-resist agents in the solution. More specifically, the improvement of the current invention comprises adding to the above stain-resist composition from about 2 to about 30 weight %, based on the weight of the stain-resist composition, of an anionic surfactant in the form of an alkyl aryl sulfonic acid or an alkyl aryl sulfonate salt, and applying the preparation to the substrate at a pH of about 1.5 to about 3.0.

DETAILED DESCRIPTION OF THE INVENTION

For a detailed description of the hydrolyzed maleic anhydride copolymers and sulfonated formaldehyde condensates used in the stain-resist compositions of this invention, reference should be made to U.S Ser. No. 07/280,406, now U.S. Pat. No. 4,833,889.

The current invention provides a means to render the maleic anhydride copolymers in such stain-resist compositions stably dispersed in aqueous solutions at low pH by addition of an anionic surfactant to the stain-resist solution. Specific surfactants useful in the process to prevent precipitation of the polymeric stain-resist agents are alkyl aryl sulfonic acids, alkyl aryl sulfonate salts, and/or mixtures thereof. Preferred compounds include dodecylbenzenesulfonic acid and dodecyldiphenyloxide disulfonic acid and their respective alkali metal or ammonium salts. The sodium and disodium salts of these two acids are particularly preferred. Quantities varying from about 2 weight % to about 30 weight % based on the weight of the stain-resist composition can be used, with from about 5 to about 15 weight % being preferred.

The presence of such anionic surfactants permits the pH of the preparation being applied to be lowered without precipitation of the stain-resist composition. To achieve acceptable exhaustion and fixation of the stain-resist composition, the pH of preparation should be lowered to from about 1.5 to about 3.0, preferably from about 2.0 to about 2.5. For carpets made from yarns subject to Suessen-type heat-setting, pH values at the higher end of the broad range can generally be used.

Any acid capable of lowering the pH of the solution to these levels without causing excessive corrosion may be used, with sulfamic or phosphoric being preferred. The anionic surfactant is preferably added to the solution prior to reducing the pH. However, it may also be added following pH adjustment if sufficient agitation and time is provided for the precipitate to redisperse. The stain-resist compositions can be applied to textile substrates using any of the above-mentioned continuous processes or other similar processes such as those involving flood applicators or modifications thereof, all of which are well known to those skilled in the art.

Polyamides which can be rendered stain-resistant using the processes of this invention include nylon 6,6, nylon 6 and other polyamides commonly used in carpet and textile applications.

Test Methods

In the test procedures and examples described below, all percentages are by weight unless otherwise indicated.

Stain Test

The standardized Stain Test used herein consists of two parts: 1) a 24 hour stain test on "As Is", i.e. tufted and dyed, unwashed carpet; and 2) a 24 hour stain test on a carpet which has been subjected to a wash prior to staining (referred to as "After Wash"). The staining agent for both the "As Is" and "After Wash" evaluations is a solution prepared from commercially-sold, cherry-flavored, sugar-sweetened Kool-Aid ® premix. The solution is made by dissolving 45 grams of this Kool-Aid ® premix powder in 500 ml of water, and it is allowed to reach room temperature, i.e., 75° F. (±5° F.) or 24° C. (±3° C.), before using.

"As Is" Evaluation

For the "As Is" evaluation, a 15 gram sample of carpet is prepared. Half of this sample is immersed in 40 $cm^3$ of the staining agent. Ihe staining agent is worked into the tufts for uniform staining. The sample is then placed on a flat non-absorbent tray or surface. The sample is left undisturbed for 24 hours (±4). Then the stained sample is rinsed thoroughly with cool tap water, extracted to remove excess liquid, and dried.

The stain resistance of the carpet is visually determined by the amount of color left in the stained area of the carpet. This is referred to as the stain rating, and is herein determined according to the Stain Rating Scale (a copy of which is currently used by and available from the Flooring Systems Division of E. I. du Pont de Nemours and Company, Wilmington, DE 19898). These colors can be categorized according to the following standards:

5= no staining
4= slight staining
3= moderate staining
2= considerable staining
1= heavy staining In other words, a stain-rating of 5 is excellent, showing good stain-resistance, whereas 1 is a bad rating, showing persistence of heavy staining.

"After Wash" Evaluation

For the "After Wash" evaluation, a 15 gram sample of carpet is prepared. A detergent solution is made by adding 57 grams of Duponol ® WAQE to 3.8 liters of water and adjusting the pH to 10.0 with about 0.2% trisodium phosphate, and allowing the solution to reach room temperature, i.e., 75° F. (±5) or 24° C. (±3), before using. The carpet sample is completely immersed in the detergent solution for 5 minutes, the detergent solution being discarded after each wash. Then the sample is rinsed thoroughly with cool tap water, extracted to remove excess liquid, and dried.

The staining agent is then applied and evaluated in the same manner as described above in the "As Is" evaluation.

For a carpet to be considered to have adequate stain resistance, it should have a rating of at least 4 the above-described Stain Rating Scale for both the "As Is" and "After Wash" evaluations.

EXAMPLE 1

A BCF (bulked continuous filament) nylon 6,6 yarn of 1140 total denier and comprised of 68 filaments (of trilobal cross-section) was produced by a conventional process. Two of these yarns were plied and twisted to provide a yarn having a balanced twist of 3.5 turns per inch (tpi). The resulting yarn was then conventionally heat-set in a Superba heat-set apparatus at 270 degrees F. A cut pile tufted carpet was constructed from the heatset yarn to the following specifications: 40 oz/sq-.yd., ¾" pile height, ⅛ gauge, 8¼ stitches per inch. This carpet was dyed to a light blue shade using a Kusters Fluidyer® on a continuous dye line. A conventional continuous dye process (at 400% wet pick up) and dye auxiliaries were used (color formula was the following and based on weight of carpet: 0.0200% Tectilon Blue 4R (200), 0.0060% Teotilon Red 2B (200), 0.0045% Tectilon orange 3G (200), pH=6.0). After dyeing, the carpet was rinsed and extracted.

The carpet was then treated with a bath containing the stain-resist agent on a Kusters Fluidyer®. The specific stain-resist agent used was a mixture of a styrene/maleic anhydride copolymer and a sulfonated phenol-formaldehyde condensate, as described in the previously referenced U.S. Ser. No. 07/280,406. (The molar ratio of the copolymer was 1:1 styrene:maleic anhydride, and the copolymer had a number average molecular weight of 1600.) This bath was prepared by water dilution of the stain-resist composition and contained 1.2% owf (on weight of fiber) of the hydrolyzed styrene/maleic anhydride copolymer, 0.15% owf of the sulfonated phenol-formaldehyde condensation product, and 0.4% owf of sodium dodecylbenzenesulfonate. The bath was adjusted to a pH of 1.5–1.8 using sulfamic acid. The bath was applied to the carpet in a Kusters Fluidyer® at about 80 degrees F. and 400% wet pick-up on weight of fiber, followed by steaming in a vertical steamer for a residence time of 3 minutes. After the steamer, the carpet was rinsed and extracted. The carpet was subsequently treated with a commercial fluorochemical in a conventional spray application and the carpet was dried in an oven. A commercially available latex composition was applied to the carpet and oven-cured.

The carpet was tested for stain resistance by the Stain Test. The treated carpet showed no stain (rating of 5) after the 24 hour stain test "as is" and showed only slight staining (rating of 4) "after wash".

EXAMPLE 2

A carpet was constructed and dyed as in Example 1. After dyeing the carpet was rinsed and extracted. Then the carpet was treated with a bath containing the stain-resist agent on a Kusters Flexnip® applicator. The bath was prepared by water dilution of a mixture of a stain-resist composition similar to that of example 1 and the anionic surfactant Alkanol® ND, which contains the disodium salt of dodecyldiphenyl oxide disulfonic acid as its active ingredient. The mixture contained 1.20% owf of the stain-resist composition which in turn was comprised of 85.0% hydrolyzed styrene/maleic anhydride copolymer and 15.0% of a sulfonated phenol-formaldehyde condensation product. Sufficeint Alkanol® ND was in the mixture to provide 12.9% active ingredient based on the weight of the stain-resist composition or 0.15% owf. The bath was adjusted to a pH of 2.0 using sulfamic acid and was applied to the carpet at about 80 degrees F. and 350% wet pick-up on weight of fiber, followed by steaming in a vertical steamer for a residence time of 3 minutes. After the steamer, the carpet was rinsed and extracted. A commercially available latex composition was applied to the carpet and oven-cured.

The carpet was tested for stain resistance by the Stain Test. The treated carpet showed no stain (rating of 5) after the 24 hour stain test "as is" and showed only slight staining (rating of 4) "after wash".

CONTROL A

A carpet was constructed and dyed as in Example 1. After dyeing the carpet was rinsed and extracted. Then the carpet was treated with a bath containing the stain-resist agent on a Kusters Flexnip®. This bath was prepared by water dilution of the same type of stain-resist composition used in Example 1 in order to provide a bath containing 1.2% owf of the hydrolyzed styrene/maleic anhydride copolymer and 0.15% owf of a sulfonated phenol-formaldehyde condensation product. The bath was adjusted to pH 2.0 using sulfamic acid and was applied to the carpet at about 80 degrees F. and 350% wet pick-up on weight of fiber, followed by steaming in a vertical steamer for a residence time of 3 minutes. A commercially available latex composition was applied to the carpet and oven-cured.

The carpet was tested for stain resistance by the Stain Test. The treated carpet showed slight staining (rating of 4) after the 24 hour stain test "as is" and showed moderate staining (rating of 3) "after wash", thus exhibiting both poorer initial stain resistance and poorer durability in the absence of an anionic surfactant.

CONTROL B

The carpet was prepared and treated as in Example 2, except the stain-resist application bath had a pH of 4.0.

The carpet was tested for stain resistance by the Stain Test. The treated carpet showed no staining (rating of 5) after the 24 hour stain test "as is" but showed considerable staining (rating of 2) "after wash", thus exhibiting poorer fixation of the stain-resist (i.e. unacceptable durability) when the stain-resist composition and the surfactant are applied at this pH level.

We claim:

1. In a process for imparting stain-resistance to a textile substrate in continuous processes which comprises applying, as a simple aqueous preparation, an effective amount of a composition useful in imparting stain resistance to polyamide textile substrates comprising between about 95 and 30 weight % of a hydrolyzed copolymer of maleic anhydride and one or more ethylenically unsaturated aromatic monomers and between about 5 weight % and 70 weight % of a sulfonated phenol-formaldehyde condensation product which is useful as a dye-resist agent, a dye-fixing agent, a dye-reserving agent or an agent which improves the wet-fastness of dyeings on polyamide fibers, the improvement which comprises adding to the composition from about 2 weight % to about 30 weight % of an anionic surfactant in the form of an alkyl aryl sulfonic acid or an alkyl aryl sulfonate salt and applying the preparation at a pH of about 1.5 to about 3.0.

2. The process of claim 1 wherein the anionic surfactant is dodecyldiphenyl oxide disulfonic acid, an alkali metal or ammonium salt thereof.

3. The process of claim 2 wherein the anionic surfactant is the disodium salt of dodecyldiphenyl oxide disulfonic acid.

4. The process of claim 1 wherein the anionic surfactant is dodecylbenzenesulfonic acid, an alkali metal or ammonium salt thereof.

5. The process of claim 4 wherein the anionic surfactant is the sodium salt of dodecylbenzenesulfonic acid.

6. The process of claim 1 wherein from about 5 weight % to about 15 weight % of the anionic surfactant is added to the composition.

7. The process of claim 2 wherein from about 5 weight % to about 15 weight % of the anionic surfactant is added to the composition.

8. The process of claim 3 wherein from about 5 weight % to about 15 weight % of the anionic surfactant is added to the composition.

9. The process of claim 4 wherein from about 5 weight % to about 15 weight % of the anionic surfactant is added to the composition.

10. The process of claim 5 wherein from about 5 weight % to about 15 weight % of the anionic surfactant is added to the composition.

11. The process of claim 6 wherein the preparation is applied at a pH of about 2.0 to about 2.5.

12. The process of claim 7 wherein the preparation is applied at a pH of about 2.0 to about 2.5.

13. The process of claim 8 wherein the preparation is applied at a pH of about 2.0 to about 2.5.

14. The process of claim 9 wherein the preparation is applied at a pH of about 2.0 to about 2.5.

* * * * *